US009114315B1

(12) United States Patent
Tseng

(10) Patent No.: US 9,114,315 B1
(45) Date of Patent: Aug. 25, 2015

(54) PLAYING CARD OUTPUT AND RECYCLING DEVICE

(71) Applicant: Tzu-Hsiang Tseng, Taichung (TW)

(72) Inventor: Tzu-Hsiang Tseng, Taichung (TW)

( * ) Notice: Subject to any disclaimer, the term of this patent is extended or adjusted under 35 U.S.C. 154(b) by 0 days.

(21) Appl. No.: 14/220,111

(22) Filed: Mar. 19, 2014

(51) Int. Cl.

| | |
|---|---|
| ***A63F 1/12*** | (2006.01) |
| ***A63F 1/14*** | (2006.01) |
| ***A63F 1/10*** | (2006.01) |
| ***G07F 17/26*** | (2006.01) |

(52) U.S. Cl.
CPC ... *A63F 1/12* (2013.01); *A63F 1/10* (2013.01); *A63F 1/14* (2013.01); *G07F 17/26* (2013.01)

(58) Field of Classification Search
CPC ..... A63F 1/12; A63F 1/10; A63F 1/062; G07F 17/26
USPC ..... 273/149 R, 149 P, 309; 463/22
See application file for complete search history.

(56) References Cited

U.S. PATENT DOCUMENTS

| | | | | |
|---|---|---|---|---|
| 5,199,710 | A * | 4/1993 | Lamle | 463/22 |
| 8,262,462 | B2 * | 9/2012 | Lai | 463/22 |
| 2002/0187821 | A1 * | 12/2002 | Soltys et al. | 463/11 |
| 2004/0259618 | A1 * | 12/2004 | Soltys et al. | 463/11 |
| 2007/0238506 | A1 * | 10/2007 | Ruckle | 463/16 |
| 2008/0150231 | A1 * | 6/2008 | Moody | 273/149 R |
| 2013/0337922 | A1 * | 12/2013 | Kuhn et al. | 463/47 |

* cited by examiner

*Primary Examiner* — Benjamin Layno
(74) *Attorney, Agent, or Firm* — Raymond Y. Chan; David and Raymond Patent Firm

(57) ABSTRACT

A playing card output and recycling device is provided for an electronic automation playing card game system to print, output, and recycle playing cards. The device is connected to the game system to print the same playing cards having the same suit and number dealt by the automation deal system. The device includes a main frame, a telescopic cylinder, a guide plate, a printer, and a recycling box. The guide plate is pivotally connected to the main frame. The telescopic cylinder has a telescopic rod to ascend or descend one end of the guide plate so as to guide the playing cards from the printer to be output or recycled to the recycling box for the players to get and squint at the playing cards like a real poker. The present invention enhances the fun and excitement of the game.

6 Claims, 6 Drawing Sheets

PLAYING CARD OUTPUT AND RECYCLING DEVICE

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

1. Field of Invention

The present invention relates to a playing card output and recycling device, and more particularly to a playing card output and recycling device connected to an electronic automation playing card game system to print playing cards same as the poker cards dealt by the game system.

2. Description of Related Arts

Poker is a widely popular game. According to different game rules, the players can have different fun. In a tense moment, the players usually squint to know the cards to enhance the fun and excitement of the game. These days, an automation playing card game system is developed. The game system comprises a server, a deal device, a robot arm, a recycling device and a terminal, which can deal, turn over, change, set, and clear the cards automatically and show the cards on the terminal, without human touch completely. Although it can avoid cheating to improve the fairness and the speed of the game, but the players don't have a true feeling of playing cards and cannot squint at the poker cards. This greatly reduces the fun and excitement of the automated poker game. Accordingly, the inventor of the present invention has devoted himself based on his many years of practical experiences to solve these problems.

SUMMARY OF THE PRESENT INVENTION

The primary object of the present invention is to solve the aforesaid problems and to provide a playing card output and recycling device. The playing card output and recycling device is connected to an electronic automation playing card game system to print the same cards when the game system deals. The same playing cards printed by a printer are guided to the players through a guide plate of the present invention. After use, the playing cards are guided into a recycling box through the guide plate. The present invention can imitate the real poker for the automation game system.

Preferably, the guide plate is provided with a sensor to sense whether the playing cards are output or recycled. Two sides of the recycling box are provided with sensors to sense whether the recycling box is full of the playing cards. The present invention achieves automatic check, judgment and notification for the game system to ensure the game can be performed exactly.

DETAILED DESCRIPTION OF THE PREFERRED EMBODIMENT

Embodiments of the present invention will now be described, by way of example only, with reference to the accompanying drawings.

Figure 1:
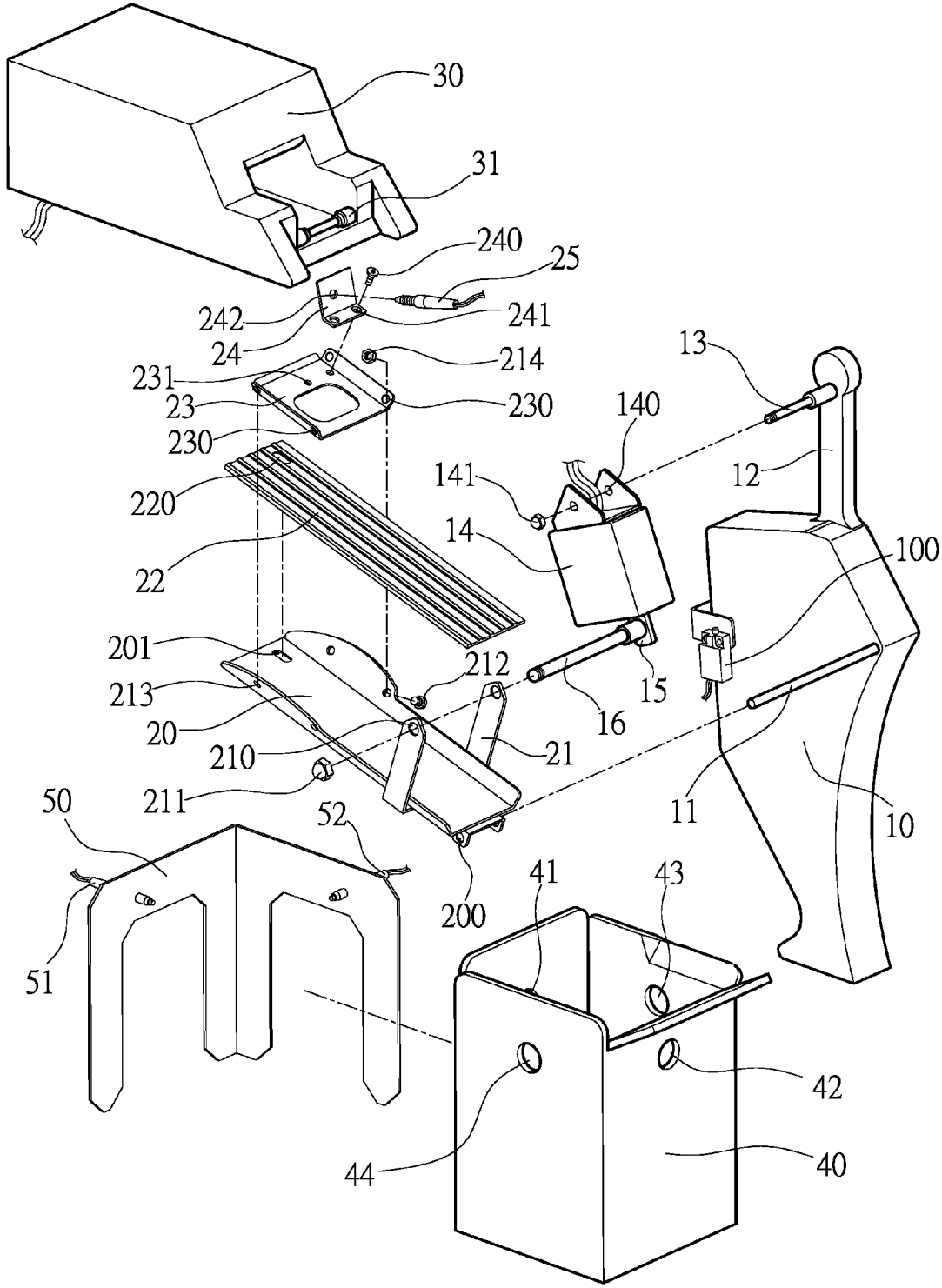
FIG. 1 is an exploded view according to a preferred embodiment of the present invention.
Figure 2:
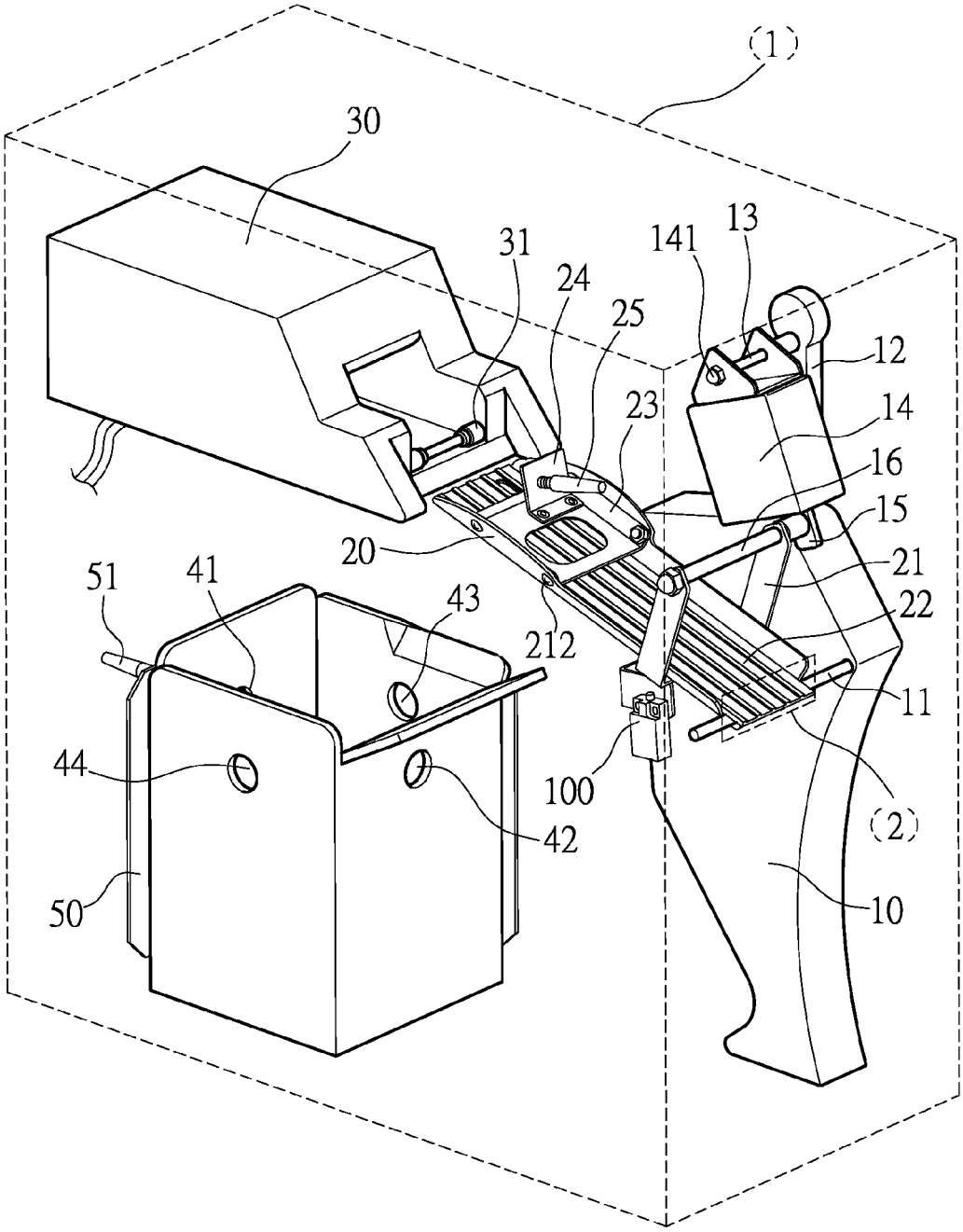
FIG. 2 is a perspective view according to the preferred embodiment of the present invention.
Figure 3:
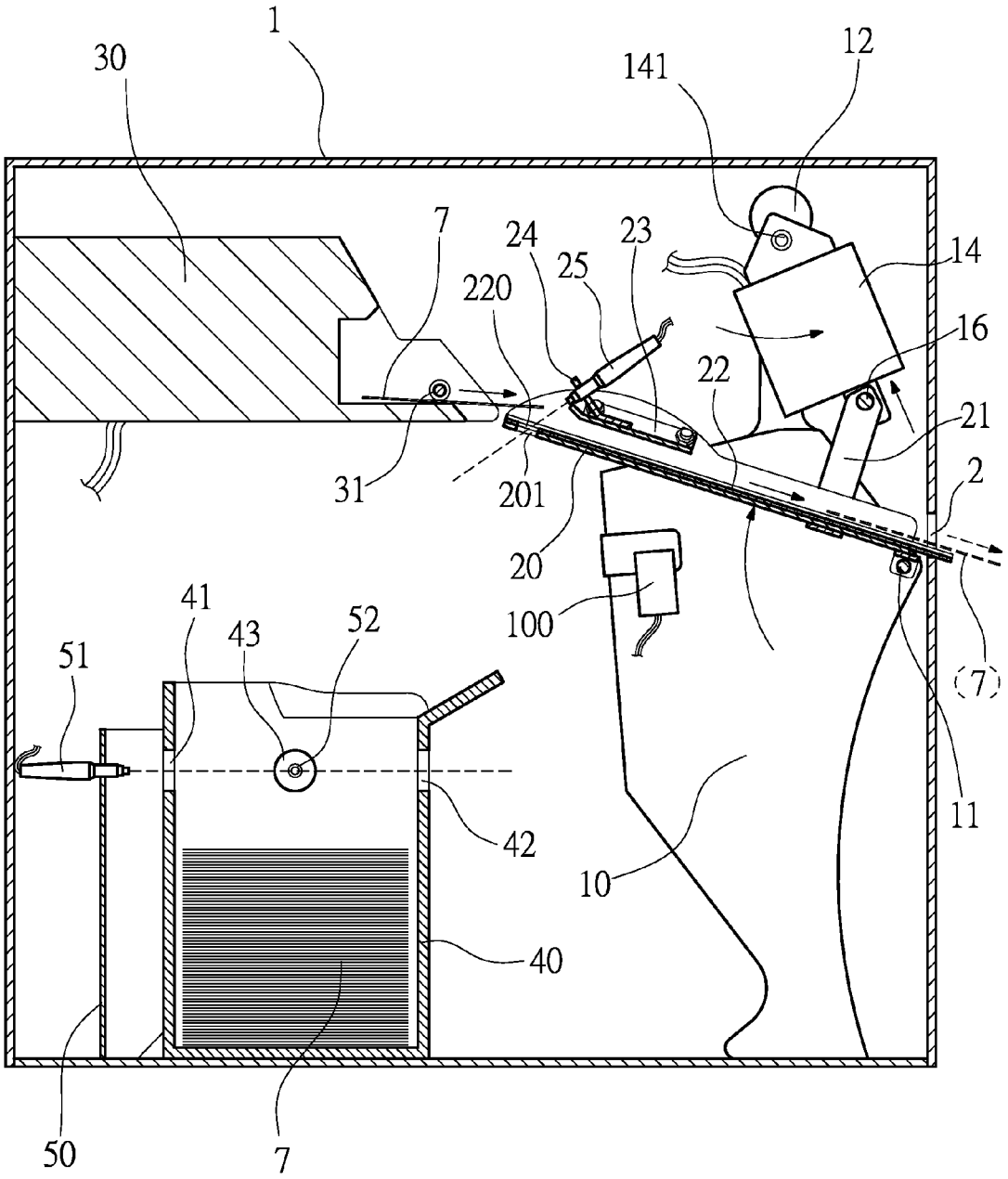
FIG. 3 is a sectional view according to the preferred embodiment of the present invention, showing the operation to output playing cards.

As shown in FIG. 1, FIG. 2 and FIG. 3, the playing card output and recycling device of the present invention comprises a main frame 10, a telescopic cylinder 14, a guide plate 20, a printer 30, a recycling box 40, and a casing 1.

The main frame 10 has a first shaft 11 thereon and an extension support 12 at a top end thereof. The extension support 12 has a second shaft 13 thereon.

The top end of the telescopic cylinder 14 has a second shaft hole 140. The second shaft 13 is pivotally connected to the second shaft hole 140. The bottom of the telescopic cylinder 14 is provided with a telescopic rod 15. The distal end of the telescopic rod 15 is provided with a third shaft 16.

The bottom of one end of the guide plate 20 has a first shaft hole 200. The first shaft 11 is pivotally connected to the first shaft hole 200. The guide plate 20 is provided with an extension arm 21 which is located between the center of the guide plate 20 and the first shaft hole 200 and perpendicular to the guide plate 20. The distal end of the extension arm 21 has a third shaft hole 210. The third shaft 16 is pivotally connected to the third shaft hole 210. A ribbed plate 22 is provided on the surface of the guide plate 20. The upper end of the guide plate 20 is equipped with a separator 23. A space is defined among the separator 23, the guide plate 20, and the ribbed plate 22. The separator 23 is provided with a fixing plate 24. The fixing plate 24 has a positioning hole 242 for a sensor 25 to be coupled thereat. The guide plate 20 has a through hole 201, and the ribbed plate 22 also has a corresponding through hole 220. The sensor 25 is to aim at the two through holes 201, 220.

The printer 30 has a guide roller 31 and is adapted to print playing cards 7.

The recycling box 40 has through holes 41, 42, 43, 44 at four sides thereof, and is provided with an L-shaped support 50 on a circumferential wall thereof. The support 50 is provided with sensors 51, 52 to aim at the through holes 41, 42, 43, 44.

The casing 1 is adapted to cover the aforesaid parts, and has an opening 2 corresponding in position to the guide plate 20.

Through the aforesaid structure, one end of the guide plate 20 can be ascended to guide the playing cards 7 out of the printer 30 or descended to guide the playing cards 7 into the recycling box 40.

The assembly of the present invention is explained hereinafter. As shown in FIG. 1, FIG. 2 and FIG. 3, one end of the guide plate 20 of the present invention is as the pivot, and the other end of the guide plate 20 is ascended or descended to be a conveyer having a slope. By the gravity, the playing cards 7 can slide down from a high position without any power to deliver the playing cards 7. The first shaft 11 of the main frame 10 is very close to the opening 2 of the casing 1 to ensure that the pivot end of the guide plate 20 won't be away from the opening 2 when the guide plate 20 is turned, so that only one opening 2 is required for showing cards or discarding cards. The telescopic cylinder 14 is pivotally connected to the second shaft 13 and locked with a nut 141 so that the telescopic cylinder 14 can deflect and won't depart from the second shaft 13. The third shaft 16 on the telescopic rod 15 is pivotally connected to the extension arm 21 of the guide plate 20 and locked with a nut 211, such that the guide plate 20, the telescopic cylinder 14 and the main frame 10 are connected together. Thus, when the telescopic rod 15 is extended or retracted, the extension arm 21 is brought to turn the guide plate 20 for the free end of the guide plate 20 to tilt upward or incline downward. Because the guide plate 20 is turned and the angle of the extension arm 21 is changed, the telescopic cylinder 14 deflects to cooperate with the position of the third shaft hole 210. The ribbed plate 22 is attached to the surface of the guide plate 20. The ribbed plate 22 has a plurality of ribs to form a wavy surface which is adapted to decrease the contact surface of the playing cards 7 when the playing cards 7 are delivered so as to decrease friction. This can prevent the playing cards 7 from getting contact with the guide plate 20 fully to bring great friction which causes the playing cards 7 to be sucked and not delivered. Two sides of the guide plate 20 have wings which are slightly tilted and formed with lock holes 213. The upper end of the guide plate 20 is equipped with the separator 23. The separator 23 has lock holes 230 corresponding to the lock holes 213, and is secured to the guide plate 20 by bolts 212 and nuts 214 to form a space among the separator 23, the ribbed plate 22 and the guide plate 20 for the playing cards 7 to pass. The surface of the separator 23 has lock holes 231. The upper end of the separator 23 is equipped with the L-shaped fixing plate 24. The fixing plate 24 has lock holes 241 corresponding to the lock holes 231, and is secured to the separator 23 by bolts 240. The fixing plate 24 has the positioning hole 242 for connecting the sensor 25. The guide plate 20 and the ribbed plate 22 have the through holes 201, 220. The sensor 25 can shoot an infrared ray to aim at the through holes 201, 220. When the infrared ray is obstructed to immediately sense pass of the playing cards 7, the game system is notified to proceed with the next instruction. The playing cards 7 are the same as the poker cards dealt by the electronic automation playing card game, in the same suit and number. When the game system deals the cards, the printer 30 simultaneously prints out the playing cards 7 and the guide roller 31 is driven to bring the playing cards 7 to the surface of the ribbed plate 22 of the guide plate 20.

Referring to FIG. 3, when the game system deals the cards to the players, the terminal shows that the cards are covered, at the same time, the telescopic rod 15 of the telescopic cylinder 14 is retracted inward to bring the guide plate 20 to lift up and the telescopic cylinder 14 to deflect for the guide plate 20 to connect with the printer 30. The printer 30 prints out the playing cards 7 same as shown in the screen. The playing cards 7 are brought to the surface of the ribbed plate 22 through the guide roller 31 and pass the sensor 25 to obstruct the infrared ray. The game system confirms that the playing cards 7 have been sent to the players through the opening 2, such that the players can get and squint at the playing cards 7. In this way, the players have the fun and excitement after getting the real cards, changing the dull and humdrum operation of the electronic automation playing card game machine.

Figure 4:
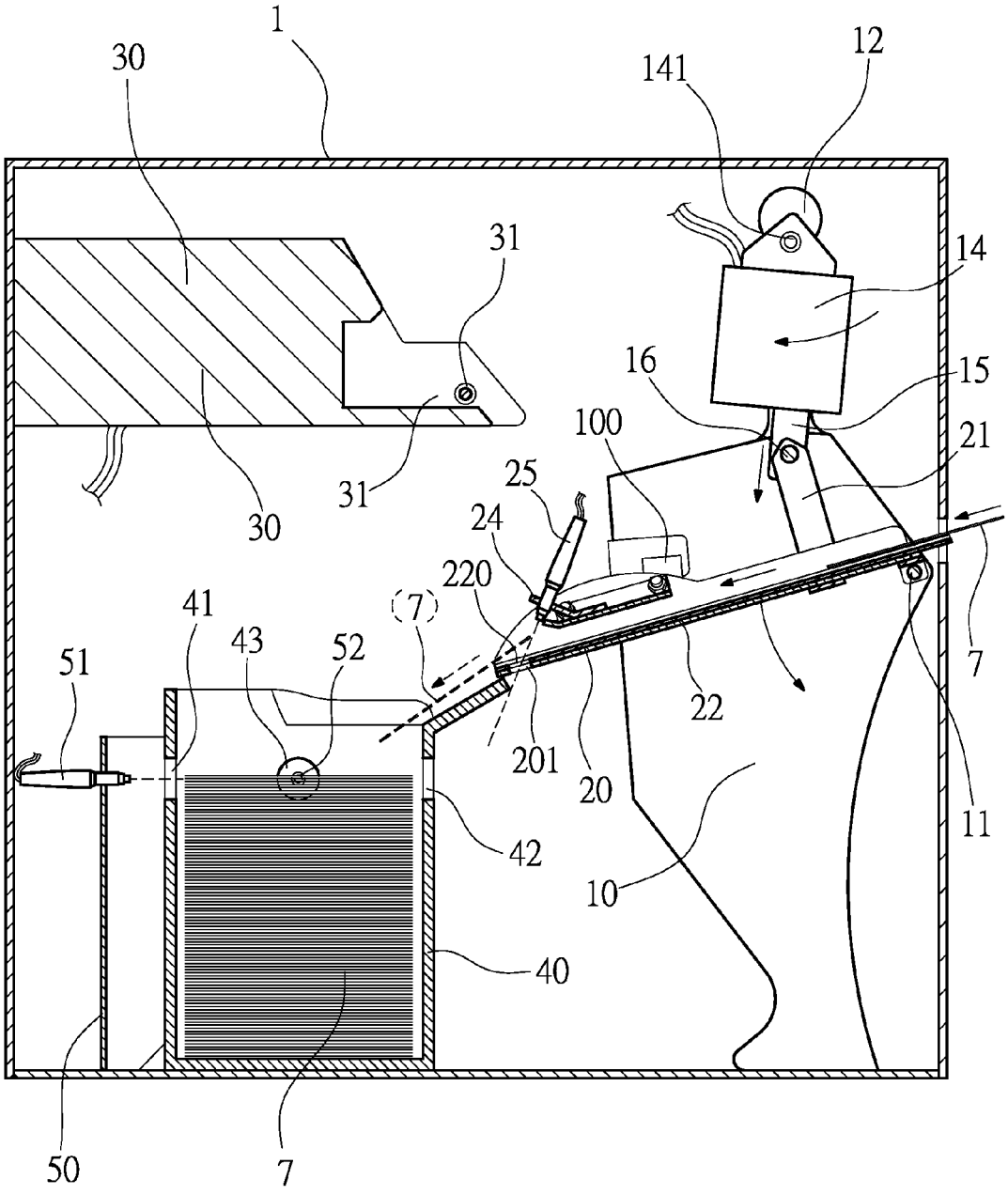
FIG. 4 is a sectional view according to the preferred embodiment of the present invention, showing the operation to recycle the playing cards.

Referring to FIG. 4, after the playing cards 7 are sent to the players, the telescopic rod 15 of the telescopic cylinder 14 is extended automatically within the set time to bring the guide plate 20 to incline downward and the telescopic cylinder 14 to deflect for the guide plate 20 to connect with the recycling box 40. The side of the main frame 10 is provided with a proximity switch 100 to sense whether the guide plate 20 is in the right position and to notify the game system to cut off the power of the telescopic cylinder 14 to stop operation. After the players know the playing cards 7, the players throw the playing cards 7 into the opening 2. The playing cards 7 are brought to the surface of the ribbed plate 22 and pass the sensor 25 to obstruct the infrared ray. The game system confirms that the playing cards 7 have been recycled to the recycling box 4, and then the terminal reveals the cards. The sensors 51, 52 of the support 50 on the circumferential wall of the recycling box 40 are to aim at the through holes 41, 42, 43, 44. When the recycled playing cards 7 are higher than the sensors 51, 52 to obstruct the infrared ray, the game system will know that the recycling box 40 is full of the playing cards 7 and needs to be cleaned.

Figure 5:
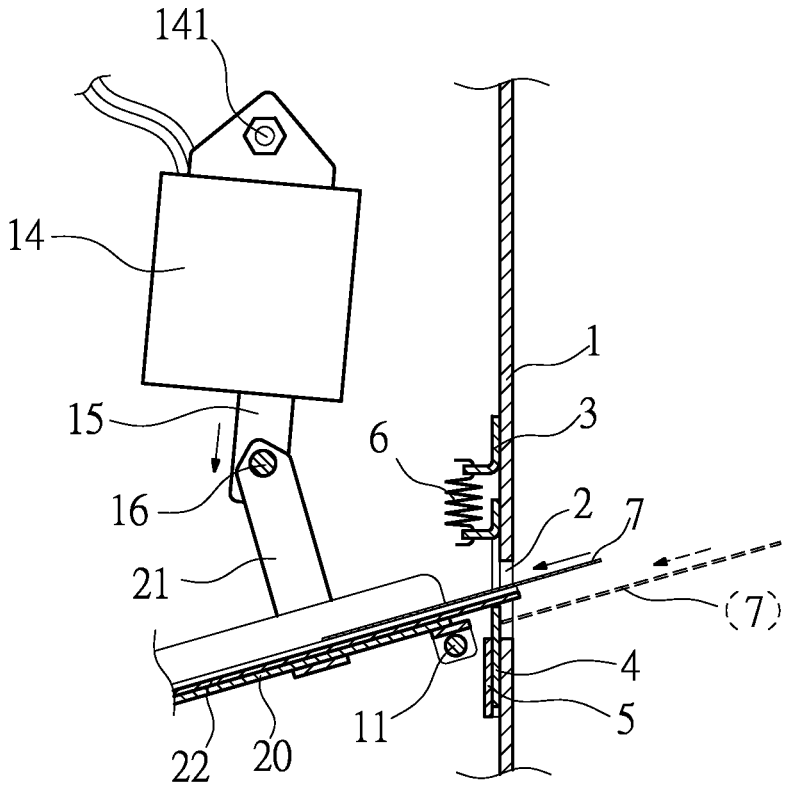
FIG. 5 is a schematic view according to the preferred embodiment of the present invention, showing a slide board being ascended.
Figure 6:
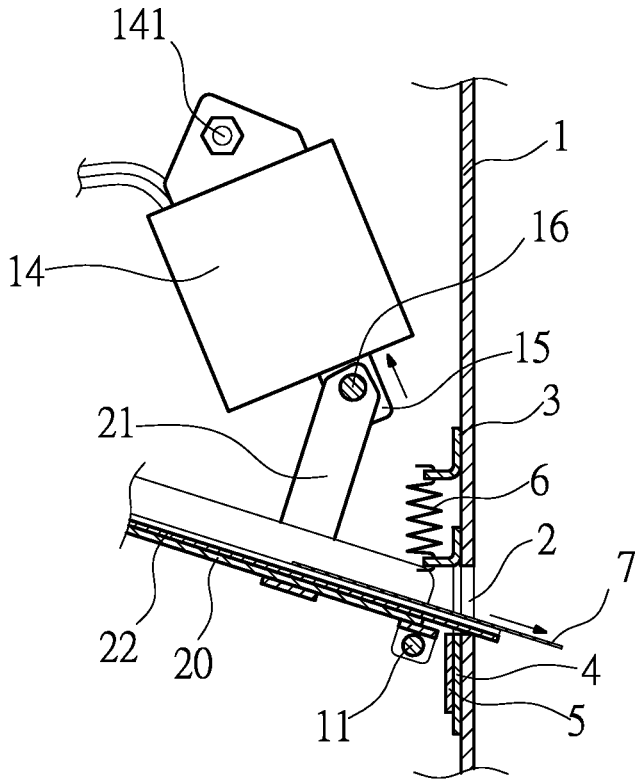
FIG. 6 is a schematic view according to the preferred embodiment of the present invention, showing the slide board being descended.

Referring to FIG. 5 and FIG. 6, the inner surface of the opening 2 is provided with a slide board 4 and a limit board 5 disposed on the slide board 4 to limit the slide direction of the slide board 4. A support board 3 is provided above the slide board 4. The support board 3 is connected with a spring 6. When the guide plate 20 is inclined downward, the distance between the opening 2 and the first shaft 11 makes the guide plate 20 higher than the bottom edge of the opening 2. The slide board 4 is pulled by the spring 6 to close upward. This prevents the players from throwing the playing cards 7 to the lower edge of the guide plate 20 in the opening 2 to result in that the playing cards 7 are not recycled to the recycling box 40 to make a mistake of the game. When the guide plate 20 is lifted upward, the slide board 4 is pressed by the guide plate 20 to slide downward, and the spring 6 is pulled to extend, and the guide plate 20 is against the edge of the opening 2 to output the playing cards 7.

Through the foregoing structure, the present invention provides a device to print, output, and recycle the playing cards of the electronic automation playing card game system for the players to get and squint at the playing cards like a real poker. The present invention enhances the fun and excitement of the game.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A playing card output and recycling device, connected to an automation game system, comprising:

a main frame having a first shaft thereon and an extension support at a top end thereof, the extension support having a second shaft thereon;

a telescopic cylinder having a second shaft hole at a top end thereof, the second shaft being pivotally connected to the second shaft hole, a bottom of the telescopic cylinder being provided with a telescopic rod, a distal end of the telescopic rod being provided with a third shaft;

a guide plate having a first shaft hole at a bottom of one end thereof, the first shaft being pivotally connected to the first shaft hole, the guide plate being provided with an extension arm which is located between the center of the guide plate and the first shaft hole and perpendicular to the guide plate, a distal end of the extension arm having a third shaft hole, the third shaft being pivotally connected to the third shaft hole;

a printer having a guide roller and disposed above the guide plate, the printer being adapted to print playing cards;

a recycling box disposed under the guide plate; and a casing adapted to cover the main frame, the telescopic cylinder, the guide plate, the printer and the recycling box, the casing having an opening corresponding in position to the guide plate.

2. The playing card output and recycling device as claimed in claim 1, wherein a ribbed plate is provided on an upper surface of the guide plate.

3. The playing card output and recycling device as claimed in claim 1, wherein an upper end of the guide plate is equipped with a separator, a space being defined between the separator and the guide plate, the separator being provided with a fixing plate, the fixing plate having a positioning hole for a sensor to be coupled thereat, the guide plate having a through hole for the sensor to aim at the through hole.

4. The playing card output and recycling device as claimed in claim 3, wherein the recycling box has through holes at four sides thereof and is provided with an L-shaped support on a circumferential wall thereof, the support being provided with sensors to aim at the through holes.

5. The playing card output and recycling device as claimed in claim 4, wherein the main frame is provided with a proximity switch.

6. The playing card output and recycling device as claimed in claim 1, wherein an inner surface of the opening of the casing is provided with a slide board and a limit board disposed on the slide board to limit a slide direction of the slide board, a support board being provided above the slide board, the support board being connected with a spring.

* * * * *